US007413008B2

(12) United States Patent
Basso

(10) Patent No.: US 7,413,008 B2
(45) Date of Patent: Aug. 19, 2008

(54) TOOL FOR FLUID FILLING AND CIRCULATION DURING OILFIELD WELL TUBING

(76) Inventor: Antonio Carlos Cayetano Basso, Lamadrid 503, Rio IV, Pcia. de Córdoba (AR)

( * ) Notice: Subject to any disclaimer, the term of this patent is extended or adjusted under 35 U.S.C. 154(b) by 451 days.

(21) Appl. No.: 11/188,835

(22) Filed: Jul. 26, 2005

(65) Prior Publication Data

US 2006/0027360 A1 Feb. 9, 2006

(30) Foreign Application Priority Data

Aug. 6, 2004 (AR) ..... P20040102816

(51) Int. Cl.
*E21B 19/16* (2006.01)
*E21B 21/00* (2006.01)

(52) U.S. Cl. ..... 166/90.1; 166/77.4; 166/96.1; 166/75.15

(58) Field of Classification Search ..... 166/90.1, 166/77.4, 96.1, 75.15
See application file for complete search history.

(56) References Cited

U.S. PATENT DOCUMENTS 6,675,889 B1 * 1/2004 Mullins et al. ..... 166/90.1

* cited by examiner

*Primary Examiner*—Giovanna C Wright
(74) *Attorney, Agent, or Firm*—Merek, Blackmon & Voorhees, LLC

(57) ABSTRACT

A tool for use in wells to maintain a tubed pipe filled with drilling fluid supplied by a well and to circulate the fluid through a well-pipe space, the tool facilitating sliding of tubes and producing cementation of the space. The tool can be intercalated with drilling equipment between a block and a pipe elevating arrangement for tubes that are gradually coupled to make up the casing pipe. The tool is placed between amelas extending from a rig support to adjacent the pipe elevating arrangement, the tool including a support array for positioning the tool in the drilling equipment, a positioning dynamic array to move the tool upward and downward to mate the tool on, and decouple it from, a tube, and a packaging array to, during the matings, establish a hermetic, self-adjustable elastic seal for the passage of well fluid to the inside of the tube.

16 Claims, 8 Drawing Sheets

TOOL FOR FLUID FILLING AND CIRCULATION DURING OILFIELD WELL TUBING

The present application claims the priority under 35 U.S.C. 119 of Argentinian Application No. P20040102816, filed on Aug. 6, 2004, which is incorporated herein by reference in its entirety.

BACKGROUND OF THE INVENTION

As is well known, a well must always be filled with fluid during drilling. These fluids are referred to as "drilling muds" in that they have special characteristics and are of major importance during the entire drilling process. In effect, it is known that the hydrostatic pressure, through the drilling mud, creates a drive towards the well walls that prevents collapses or falls. This hydraulic action also results in the formation of water-proof plasters in high porosity areas, removing undesirable volume and level losses, and also mitigating the occurrence of spontaneous upwelling springs.

Also, these muds are useful for lubricating and refrigerating the drill bit and the tube column. In addition, when this fluid circulates during drilling, in its way up the well/drilling column annular space, it carries over detritus produced by the action of the drill bit and deposits them on the surface. On the other hand, its great gelation capacity prevents solid particles from falling over the drill bit and undesirable blocking and clogging when circulation must be interrupted for any reason. In bottom engine drilling systems, mud is responsible for transmitting the hydraulic energy necessary to drive the hydraulic engine and the drill bit. The mud is even used to transmit signals that allow tool remote control. Controlling and managing the parameters of this fluid allow for controlling of the development of operations, and to that end, it is of paramount importance to permanently maintain the continuity of the injection circuit.

In the event of contingencies, such as circulation losses caused by the admission of permeating layers, or appearance of layers with high reservoir pressure, or even the blockage of the tube column with the ring blockage, etc, when the mud injection circuit is active, the problem is generally readily solved by changing the mud parameters and the hydraulic conditions, without requiring to interrupt circulation.

However, if the contingency occurs while the circulation circuit is open or discontinued, the time required for its start-up is highly critical, and the ensuing problems typically require additional high risk/cost tasks.

In effect, as is well known, it is after the drilling and assessment of the well that the tubing job is performed. The aim is to install a pipe column of special strength and structure to supply the well with the necessary stability for post-exploitation tasks.

This installation operation is currently performed with the pipe open, on a pipe per pipe basis, which are joined by threading. The well is kept open for the duration of the tubing operation, and the mud circuit is discontinued.

As indicated above, it is desirable that, during tubing, the drilling fluid should be circulated from the deposit pools to the inside of the pipe, from its lower end to the well-pipe annular space and from the latter to the mud pools, to be re-pumped.

The purpose is that the fluid move forward through the mentioned annular space, so as to fill, wash or condition the well-pipe annular space at different depths.

The fact is that in order to complete the aforementioned circuit, the circulation head must be assembled during tubing.

This is not a complicated task under normal operating conditions, in which case the necessary assemblies can be done quickly and the required time is not critical.

But in the event of any contingencies, such as the blockage of the pipe at any lower section, so that the open upper end, where the circulation head must be threaded, is far from the work floor, installation turns considerably difficult, and contingent risks increase.

It is also known that, in addition to pipe blockage, the incorporation of fluid that produces a weak layer decreases the level and results in differential pressure loss over strong layers, increasing the possibility of spring occurrences.

Evidently, as no drilling mud circulates through the circuit, there will be clogging and/or well shutdown due to solid deposits. It is therefore crucial to avoid delays under these circumstances.

Indeed, isolation cementation is of paramount importance in the construction of oilfield wells since the productive life of the well depends on its result.

If the cementation if flawed, it is more difficult to obtain accurate assessments that might lead to the abandonment of the well, and even of the field when the latter is exploratory.

Isolation cementation is the last phase in the drilling of an oil well. After drilling and tubing, the mentioned created annular space must be cemented.

This important operational stage is called "primary or isolation cementation" because the injected cement must fill the whole existing annular space defined between the well itself and the pipe external wall with which it is tubed to isolate the layers from one another and to affix the pipe to the assembly.

It is known that, in order to achieve effective cementation, it is necessary to prepare the well and pipe walls, ensuring that the cement that is to be injected, after hardening, has good adhesion properties, both to the pipe and the assembly, without creating undesirable interstices that might affect the perfect isolation required.

The preparation for the mentioned annular space is provided by the water cushions that are injected before the main cementing slurry.

That means that after tubing and before starting cementation, in normal conditions, the pipe and the well are filled with drilling fluid. To cement, it is previously necessary to wash the inside of the pipe to avoid the contamination of the cement fluids.

These fluids, which are injected through the inside of the pipe towards its lower end and then move up the well-pipe annular space, are: the water cushion, the removing slurry and the main or cementing slurry itself.

The separation or removal of the drilling fluid from the pipe inside is provided by a first lower plug, usually called a "fuse plug" that is located and acts before the mentioned cushions. The cement head is essentially a lower plug bearing device as well as an upper block plug bearing device, which will be launched eventually to implement the aforementioned task, that is, to prepare the annular space and then inject the water cushion and the removing and main slurries.

In known installations, the cement head must be attached to the tubing pipe through the threaded joint offered by the last coupling, and must also become integrated into the fluid injection circuit by means of a communications pair, namely: one disposed over the lower fuse plug, and the other, over the upper plug.

It is common for these derivations from the main injection circuit to include selective valves that first direct fluid circulation towards the lower fuse plug that is displaced to the lower drilling end through the pumping of the mentioned cushion and slurry.

Then, the same selective valves switch position so that the displacement fluid can be introduced over the upper block plug that presses the mentioned cement fluids contained between both plugs.

The generated hydraulic pressure causes the breakage of the fuse plug located at the pipe lower end (the fuse membrane bursts), so that the mentioned fluids contained between them are displaced from the inside of the pipe to the well-pipe annular space.

Since the mentioned displacement fluid injected behind the upper or block plug pushes the latter until it reaches the fuse plug, it can be inferred that, at that time, all the cement fluid volume is occupying said well-pipe annular space.

After hardening, the cement will isolate the productive and non-productive layers from one another and will maintain the pipe stable and fixed to the assembly.

The cement heads currently known in the art adequately perform the process explained above and can satisfy the operational requirements presented because each of the plugs can be launched at the corresponding time.

However, it is always necessary to have two inlets or connections with the fluid feed circuit to ensure that no air reaches the inside.

In all cases, the presence of operators is required at the wellhead, with the risks involved in working with the pressurized circuit.

The most modern cementation equipment includes up to three connections with the fluid inlet and two or three special compartments designed place the standby plugs until the moment of their launching.

They are very simple, effective, and easy to operate devices, but all of them are designed to be installed at the time of cementation.

Their collocation is performed once tubing is completed and after the mentioned previous drilling fluid circulation for the cleansing and conditioning of the well and the pipe.

These heads are mounted on the last pipe coupling, allowing the introduction of the mentioned cement plugs.

The most remarkable problem arising is that the fluid supply must invariably be discontinued and the circuit must be shut down in order to mount the cement head.

This is a manual mounting operation that requires the shutdown of the feed circuit, the installation of the cement head and its connections, and the installation of the plugs, after completing the tubing.

The time required by these tasks is crucial and it has been long determined that it is at this stage that contingencies are produced.

These devices invariably require the presence of operators at the wellhead to install the cement head, so that, once the latter has been installed, they can open the corresponding valves for the launching of the plugs.

This post-tubing assembly prevents the use of remote controls, which are extremely useful in centralizing operational controls, and the plug launching operation is not plotted in any graph. In this sense, it should be highlighted, for instance, that the valve change required to launch the block plug, the depression produced by the free-falling cement creates an undesirable entry of air to the circuit, that later makes flow and pressure readings more difficult, with undesirable volume returns after arrival of the block plug due to the compression of the confined air, which forces to keep the cement head closed.

This action later produces a volume increase due to the heating of the displaced fluid, contained inside the tubed pipe, which expands the latter while the cement is hardening.

When said pipe decompresses to perform the tasks subsequent to well finishing, a micro annular space is formed between the outer pipe wall and the body of the hardened cement that creates a communication between the layers, which may cause problems that might require highly complicated and costly supplementary repair works.

With respect to the self-adjustable annular seal used to contain the pressures generated from the well, it can be said that a considerable number of checks and elastic joints that serve as fluid retention devices, whether pressurized or not, in hydraulic or pneumatic mechanisms. The most used devices are the elastic toroidal joints commonly known as "O-rings". They are placed in an annular encasement or throat which size and format are usually determined by standards established by the manufacturer itself.

When the pressure affects one of the seal faces, the confinement by contact with the encasement bottom and the surface to be sealed, it pushes the sealing ring towards the back wall or bottom of said encasement; consequently, the elastic ring is deformed in the space between the axis and the bushing, efficiently closing the way to pressure.

The mechanical retention capacity of this type of joint is determined by the quality of the elastomer it is made of, based on its resistance to temperature and chemicals, hardness, machinery tolerance, etc.

Another known sealing means is the one known as "V" or "Multi V" type. These seals are not typically built with pure elastomers; they are semi-rigid and are characterized by their special shape, since they feature wings that are adjusted on the wall of the encasement bottom, so that the pressure in this case affects the inside of the wings, pushing them towards the walls to be sealed.

These seals are generally used to withstand high pressures and axial or rotational movements. Said sealing elements with "V" lips, combined with "O" rings, are commonly used to seal larger spaces and less polished surfaces.

The physical and chemical characteristics of the compounds with which these seals are built are directly related to the intended mechanical response, and to the environment to which they will be exposed.

With respect to the so called elastic checks, they generally combine a metallic structure associated to an elastomer. They are commonly used to contain fluids over rotational movements, are not capable of containing high pressures.

The self-adjustable annular ring used by the tool of the invention features considerable differences over the typical models currently in use, in that the expansible chamber connected to the contained pressure provides an additional automatic adjustment, which can be useful to perform a regulating blockage action, which, in addition to the natural elastic capability of the contact lips, increases the blockage and/or restraint action on the surface to be sealed, directly related to the tolerated pressure.

It is precisely called "dynamic pressure self-adjustable annular seal" because the blockage action increases or decreases with the increase or decrease of the pressure of the fluid contained by means of the seal.

It is a hermetic sealing means that can be used in hydraulic and/or pneumatic mechanisms, in static and/or dynamic mechanisms, sealing and/or outer blocking an axis.

This functional principle increases the blockage pressure, using the contained fluid's own pressure.

SUMMARY OF THE INVENTION

The tool according to the present invention provides a new alternative that consists in the availability at all times of an immediate and automatic response to overcome any type of requirement during the tubing and later isolation cementation, whether of horizontal, vertical or deviated oil, gas, geothermal, etc, wells.

The tool of the invention facilitates the tubing operation by providing an instantaneous circuit restoration, for casing filling with evacuation of the contained air and mud circulation, minimizing risks and providing and effective permanent control of the operation.

The tool of the invention has been especially designed to remain installed under automatic operation conditions, whenever so required.

It should be noted that this is not a tool that is installed when its intervention is deemed necessary. Its assembly does not affect pipe installation, it can be installed and may be permanently deployed when needed.

For its assembly, the tool of the invention includes an attachment means to be supported from the rig, and may be moved between the hanging arms (amelas) that support the hanger itself from the rig, from which the tubular column will hang and it will support the latter's weight, as the tubular pieces are incorporated to the column.

The mentioned free movement provided by said attachment to the rig, between amelas, allows for the alignment of the tool towards the tubular column supported by the hanger, whether to be disposed so that it can fill the pipe, or else to circulate the well fluid, or else to perform the mentioned cementation operation.

When the sealing means of the tool of the invention is placed in obstruction position, the aim is to circulate the well mud.

The tool of the invention features an important functional advantage here, since said drilling filling and/or circulation capability with respect to the well, with upward and downward movements (reciprocation) also improves the cleaning, removal and transfer of solids to the surface.

This characteristic ensures that, once the pipe has been installed in the well, the filling fluid is perfectly conditioned to perform the isolation cementation, and thus saves a considerable amount of operational time, which results in an important economic advantage.

As indicated above, the tool of the invention also carries an incorporated cement head, which means that it has considerable advantages as compared to current use methodologies.

This novelty also encompasses the advantage that fluid injection need not be discontinued for cementation.

The entire tubing/cementation operation can be performed continuously.

A constructive design has been achieved which allows the passage of circulation fluids, which are not obstructed by the plugs as in the case of conventional tools.

That is, it is ensured that the plugs are separated, cleaned and displaced, and integrated to the flow at the precise operational moment, without the need to block the fluid passage.

In order to introduce the plugs at the right time, hydraulic launching means are used, which may be programmed and commanded remotely by means of a safe, accurate centralized control, integrated with the well general command system and/or the cementation operation system.

The use of the tool of the invention does not discontinue the injection circuit at any operational moment, and it can be used to tube and cement in a single step.

For this reason, when an integrated head is included in the fluid filling and circulation equipment during tubing, operational continuity is achieved while at the same time completing drilling.

This tool integrates the tubing work with the subsequent cementation, ensuring time, control and safety continuity.

In this case, operational continuity is complete from the moment of tubing itself, and the operational control is complete and permanent.

Considerable benefits are achieved over use methodologies mentioned above, since there is no need to discontinue the fluid circulation circuit for launching the plugs; then there is no risk of air being introduced into the circuit. Cement plugs are incorporated into the flow at the required time based on previous scheduling related to well characteristics and conditions. This tool has been designed to be completely commanded remotely, and does not require personnel near wellhead.

In a preferred embodiment, the self-adjustable annular seal included by the tool to circulate the well mud comprises a specially designed annular elastic band which is mounted on a cylindrical mounting surface on one of the walls where the sealing will take place, from where it is projected to close the annular space extending from the surface facing the other wall where the seal is produced.

This seal has the particular feature that, in correspondence with at least a section of the mounting surface of said elastic annular band, an expansible internal chamber is defined, which is connected to at least a tube built on the wall, which creates a connection with the pressure fluid present in the sealed annular space.

In order to operate efficiently, an elastic band design is contemplated which includes a front face with cavities or depressions that determine the formation of lips and edges that are supported on the contact wall.

The presence of said lips and contact edges that are supported on the wall to be sealed produces a natural blockage when the seal array is in standby (without receiving pressure through the connection holes).

The opposite face of the elastic band, where it is attached, also includes cavities or depressions that form the mentioned internal elastic expansion chamber connected to the hydraulic communication tubes that extend through the wall body, from the confined pressure zone located over the upper lips or wings of the seal.

It should be highlighted that this annular band configuration will block the space to be sealed, and when exposed to great pressure differentials will allow it to go through the connection tubes to the mentioned internal expansion chamber.

The blockage is produced when the portion of the elastic band that becomes deformed against the facing wall on which it is supported, effectively occupies the free annular space to seal, producing a first effective blockage link.

When pressure is accumulated, it affects the exposed surface of the seal's upper wing, naturally increasing the blockage action.

In addition, the pressure transmitted through the connection tubes affects the mentioned internal elastic expansion chamber and the back face of the elastic ring, exposing them to a lower pressure than the zones located over the wing; this pressure differential deforms the elastic band, pushing towards the surface to be sealed, which increases the sealing capacity as the pressure differential rises.

From these constructive conditions that implement the principle of the disclosed dynamic hermetic seal, the case might also occur in which the mounting of the elastic band and the connection tube are practiced on the wall of a bushing that coaxially encloses an axis.

In this case, the separation annular space between both is precisely where the blockage is achieved.

From the above, it follows that it is the main object of the present invention to be used in vertical, horizontal or deviated wells, with the aim of maintaining the pipe to be tubed filled with the drilling fluid provided by the well, and of circulating said fluid through the well-pipe space, facilitating the movement of the tubing and also producing cementation of said space when the pipe has been installed; capable of being intercalated in the drilling equipment between the rig and the elevating hanger means that takes the pipes that are gradually attached to make up the casing pipe.

The tool of the invention is placed between the amelas that extend from the rig support to the adjacencies of the pipe elevating device of the drilling equipment, comprising a support array, responsible for positioning said tool hanging from the rig hook and aligned between the amelas; a dynamic positioning array, responsible for producing vertical upward and downward movements, which generate the matings or decouplings of the tool on the tubed pipe, and a packing array through which, during the matings, a hermetic blockage self-adjustable elastic seal is established during the passage of well fluid towards the inside of the tubing pipe.

When the block bushing is positioned so that it hermetically seals the mating with the tubing column, the tool provides well fluid to the inside of the pipe, so that a mud drive pump reestablishes circulation towards the inside of the column, in a descending direction, circulating through the inside of the column and from the lower end of the same column, in an ascending direction, circulating through the annular well-pipe space.

It should be highlighted that the support array hangs from the block hook through a bushing bolt that also goes through a couple of side plates associated with a higher core, which belongs to the body of the tool, which are affixed to it in height-selective positions to allow the variation of the total tool length, adapting it to the length of the preexisting "amelas" of the drilling equipment to ensure that its free lower end, where the packing array is located, is always at the right distance so that its operational displacements adequately produce the mating and decoupling.

It should also be highlighted that, on the body of the tool, there is an array of pairs of retractile arms carrying respective freely rotational centralizing rolls that are supported on the amelas to act as guides that prevent the tool from de-aligning vertically during operations.

It should also be highlighted that an injection head is included for fluid feed purposes, said head being located below the dynamic positioning device which, on the one hand mates with a flexible hose integrated to the mud injection circuit that originates at the drilling fluid storage pools, and on the other, connects to an internal confinement chamber, where the fluid is directed towards the pipe.

It should also be highlighted that the dynamic positioning device (6) is a hydraulic device which belongs to the body of the tool, which can be displaced vertically and in both directions, for which it comprises a fixed central rod from which two telescopic co-axial hydraulic cylinders are displaced, which are capable of producing the ascending or descending vertical movements of the body of the tool, producing the corresponding mating so that the lower packing array blocks the mud circulation circuit to fill, circulate and cement the well.

It should also be highlighted that the co-axial and telescopic hydraulic cylinders, for their ascending and descending displacements, are integrated to respective hydraulic circuits that are linked to their respective variable internal volume inner chambers with an operation pump, with intercalated electrovalves for opening and closing the circuits, said valves are commanded from the tool general command, based on pre-established operation programs. In addition, it should be noted that the packing array is made up of a block bushing capable of hermetically sealing the mating with the free pipe end coupled to the pipe, for which purpose it includes, in correspondence with its internal surface, a self-adjustable elastic annular joint encompassing the joint of said pipe.

Said block bushing includes, in correspondence with its internal surface, an elastic buffer ring, placed in the horizontal plane, which mitigates the impact of each mating of the tool over the tubular column.

Said block bushing uses a dynamic pressure self-adjustable annular seal when it is applied in the annular space through which said pressure fluid circulates with the purpose of sealing the passage;

Said self-adjustable annular seal comprises a self-adjustable elastic annular band placed on a mounting surface defined on one of the walls where the seal is to be produced, from where it projects to block the annular space that extends to the opposite surface of the other wall where the seal is produced.

It is noted that, in correspondence with at least a section of the mounting surface for said self-adjustable elastic annular band, an expansible internal chamber is defined which must be connected, through at least a tube practiced on the wall, with the pressure fluid in the sealed annular space.

Specifically, said expansible internal chamber is made up of the internal face of the elastic band and the bottom of the cavity practiced on its mounting wall.

In addition, said expansible internal chamber that is kept in permanent connection with the pressure fluid confined in the sealed annular space, it increases its volume according to the amount of fluid that enters it.

It should also be highlighted that the section that determines the mounting surface for the self-adjustable elastic band is an annular cavity that, in correspondence with its upper and lower ends includes respective anchorage annular throats for encasing corresponding higher and lower annular tabs of the elastic band.

It should also be highlighted that the elastic band that integrates the annular seal includes a higher annular wing that extends obliquely until it rests on the sealed coaxial body, defining an upper blockage lip and an annular valley that regulates the degree of blockage pressure based on the confined fluid pressure.

On the other hand, the same external face of the elastic band presents cavities that give rise to the existence of support lips producing the seal.

It should also be highlighted that the body of the displaceable positioning device in the vertical and in both directions, carries a cement head capable of allowing for the launching of the cement plugs required for moving the hardening fluids and placing them in the well-pipe annular space with the purpose of isolating the layers from one another and anchoring the tubing pipe to the assembly.

Said cement head is constituted adjacently to the mentioned push and confinement chamber connected from above with the circulation fluid injection line, and from below, with the inside of the packing array; said chamber is laterally connected with a lower pocket aligned with an upper pocket that make up the temporary encasements of the cement plug that in turn face their respective displacement launchers capable of moving them until they are positioned inside said push chamber, in conditions of being circulated by the circulation fluid moving through the tubing pipe.

It should be noted that the push and confinement chamber is laterally blocked by the wall of a carrying box that is located inside the lower pocket and is operated by the displacement launcher when each plug is displaced to the injection line.

In addition, said launchers are associated with hydraulic operation means linked to remote command means that control the operational displacements of the plugs towards the injection line based on hardening fluid volume required to complete the well-pipe space to be cemented.

In addition, the push and confinement chamber is co-axial with the tubing pipe axis through which the drilling fluid circulates, and includes an air outlet during tubing, keeping the cement plugs stand-by until they need to be used.

It should also be noted that the push and confinement chamber, for the air outlet during tubing, includes a fluid level detector commanded by an air outlet check valve, so that when the level of the fluid entering the push and confinement chamber to connect with the pipe does not reach the adequate level, a valve means is kept open to allow the air to exit.

It should be highlighted that said push and confinement chamber, for the air outlet during tubing, includes a fluid level detector commanded by an air outlet check valve, so that when this valve means is in closed position because the fluid level is adequate, it causes the blockage, allowing the drilling fluid to move through the inside of the tubular column and up the well-pipe tubular space by the action of the pressure induced by the confinement.

It is noted that the fluid detector level comprises a float associated with a contactor that commands the air outlet check valve.

In addition, it should be noted that the valve means for the outlet of air during tubing comprises a block plug which rod is counteracted with an expansion spring that keeps it in a normally open position.

It is noted that between the lower and upper pockets, aligned with respect to one another, a displaceable stopper (that prevents the displacement of the block plug placed on the upper pocket) associated with a hydraulic operating means.

Finally, it is highlighted that the amelas are guide and alignment elements for the tool that in these conditions is longitudinally displaced to produce the matings and decouplings of its packing array.

It is the main object of the present invention to be used in vertical, horizontal or deviated wells, and to stay installed in automatic operating conditions whenever required.

More specifically, this invention contemplates a tool especially created to introduce fluids in the tubed piping, using the same drilling fluid that fills the well, and to circulate same through the well-pipe space, at any time during tubing, or to circulate cementation fluids when layer isolation or pipe anchorage to the assembly is required.

The supply of circulating fluid is performed as many times as required, without delay and simultaneously with the tubing, which facilitates sliding of the descending pipe.

In this way, an automatic and immediate solution is provided, particularly for cases in which the pipe must be deployed in narrow well sites and/or with fluid admission, where spontaneous obstructions can occur, simplifying release works.

For these tasks, the tool of the invention includes a special sealing resource aimed at containing the pressure that might generate at the well, which can be applied at the threaded joint of the last pipe integrating the tubing column, so as to seal the passage of pressurized fluid and allow the injection of pressure fluid from the tubing column to the annular space through which it circulates.

The tool of this invention is also supplied with a level detector, connected to a valve that allows air release at the beginning of the injection of the fluid that will fill the empty pipe section, ensuring the absence of gases that might affect the density of the driven fluid column. As indicated above, the same tool of the invention can act as a "Cement Head", allowing launching of the cement plugs required for separation, while the hardening fluids that must be placed in the well-pipe annular space are circulating, with the aim of isolating layers from one another and affixing the pipe to the assembly.

It is thus possible to efficiently perform the cementation job without having to open or cut the injecting circuit, removing the need to use operators at the wellhead, centralizing operations in one command and control unit that can be placed "remotely", which allows for increased safety and efficiency.

Thus, it should be noted that this is not a tool that is installed when its intervention is deemed necessary.

Since its assembly does not affect pipe installation, it can be installed and may be permanently deployed for when it is needed.

In order to prevent well fluid from stemming out of the open end of each pipe as it is attached to the tubing pipe, the tool of the invention resorts to the use of a very special dynamic seal that blocks external communication and balances internal pressures, allowing the completion of the tubing tasks.

It is referred to as "dynamic seal" since it is a self-adjustable elastic seal, especially created to withstand high pressure differences, transmitted by any fluid type, whether in liquid or gas form.

Its operation principle lies in that the pressure, confined before the elastic element forming the seal, works in an expansible chamber placed on the same sealing element, matching the affixing face opposite to the face producing the hermetic elastic blockage.

Said chamber, by action of pressure increase, deforms the elastic body towards the external wall of the tube, creating a higher self-adjusting capacity than the natural blockage and adjusting capacity of the elastic element in itself.

The aim is to make up an expansible chamber connected to the same pressure that is to be contained, in so achieving an automatic adjustment for the sealing action that results in an enhanced the blocking action on the surface to seal, directly associated with the withstood pressure.

Having a tool capable of controlling said contingencies at any time will undoubtedly mitigate operational failures, while decreasing costs and risks.

Even better, once the well has been tubed, the same tool is used to perform cementation, which thus prevents the process from discontinuing, since it removes the source for the need to close the circuit to mount the cement head.

It is no longer necessary to close the feed circuit after completing tubing, removing the presence of operators at the wellhead so that, once the cement head has been installed, they can proceed to launch the cement plugs.

BRIEF DESCRIPTION OF THE DRAWINGS

In order to realize the advantages so briefly discussed, which can be numerously expanded by users and by those skilled in the art, and to facilitate the understanding of the constructive, constitutional and functional features of the tool of the invention, a preferred embodiment example is described, which is illustrated schematically and at no determined scale, in the attached pages, with the express consideration that, precisely for being exemplary in nature, it does not intend to assign a limitative or exclusive character to the protection scope of this patent of invention, but simply serves an illustrative and explanatory intention of the basic conception on which it is based.

It should be noted that, for all the figures, the same reference numbers and letters match the same or equal parts or constitutional elements of the assembly, according to the example selected for this explanation of the tool of the invention.

DETAILED DESCRIPTION OF A PREFERRED EMBODIMENT

Figure 1A:
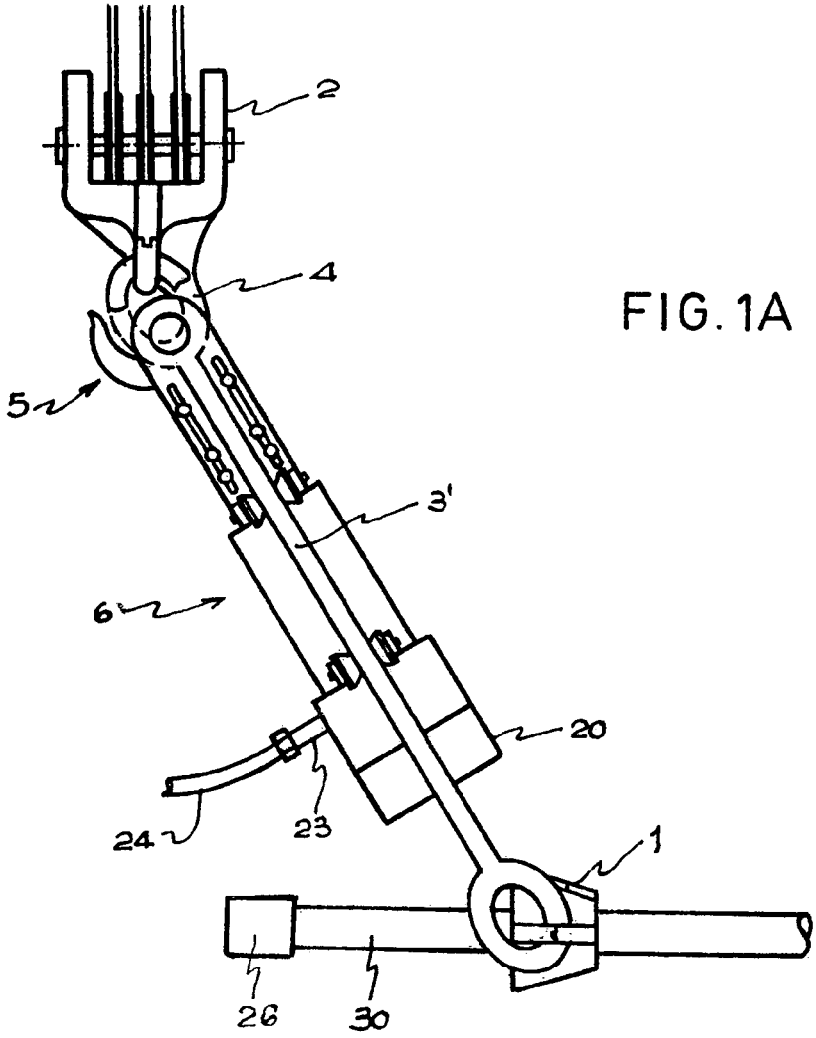
FIG. 1A is a lateral joint view that shows the tool of the invention, intercalated between a block and the hanging-elevating means that weaves the tubes that make up the pipe.

As can be appreciated from FIG. 1, the tool for filling and circulating the fluid during the tubing of oilfield wells of the present patent of invention has been especially designed to be intercalated between the elevating device (1) and the block (2), between the connectors, or amelas, (3/3') (visible in FIG. 4) which link said pipe elevator (1) with said block (2) of the drilling equipment.

It should be noted that these elements (1/2/3/3') are only schematically represented so as not to confuse the object of this invention, and that it is not subject to the characteristics or conditions featured by them and that are common to most drilling equipment. In this preferred example, the tool of the invention operates between said amelas (3/3'), supported from hook (4) of the block, to which it is connected, in this case, through the support array (5).

FIG. 1A shows that the mounting of the tool of the invention does not affect the operation of the drilling equipment when taking a tube (30), lifting it, aligning it with the tubing pipe, and through a turning movement, attaching it by threading to the section taken from that pipe so that it finally produces the lowering of the array towards the inside of the well, incorporating a new tube to the tubular column that remains positioned at the work floor (38) through the wedges (37) and the rotary table (39), entering the well itself.

Figure 1B:
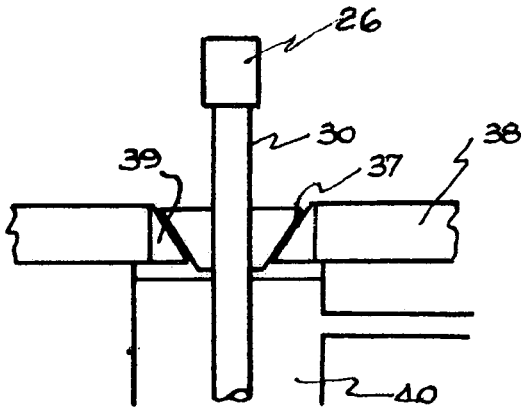
FIG. 1B is a schematic lateral view that shows a new tube incorporated in the tubular column positioned at the work floor.

FIGS. 1A and 1B show that the tool accompanies these movements without interfering with them, since it maintains its hanging position from the block, centered between the "amelas", while said drilling equipment integrates a new tube to the tubular column positioned on the work floor (38) through the wedges (37) and the rotary table (39), entering the well itself (40).

The purpose of the tool of the invention consists in an automatic drilling fluid supply to the inside of the pipe so that the well-pipe annular space is constantly filled with fluid, doing away completely with the need to interrupt tubing to place the fluid circulation head when any contingency is produced.

In this way, an instantaneous circuit restoration for casing filling and mud circulation is provided.

The tool of the invention is designed to mate over the joint couple (26) of each tube (30) making up the pipe, integrating the tubing and reestablishing communication to allow well fluid circulation.

In order to implement said purpose, the tool of the invention is made up with a support array (5), responsible for positioning the tool hanging from the hook (4) of the block and aligned between the "amelas" (3/3'); a dynamic positioning array (6), responsible for producing the mentioned upward and downward movements in the vertical direction, which generate the matings or decouplings of the tool on the tubing pipe; a packing array made up of the block bushing (20), through which a self-adjustable elastic hermetic blockage seal is created during the passage of well fluid to the inside of the tubing pipe.

Figure 2:
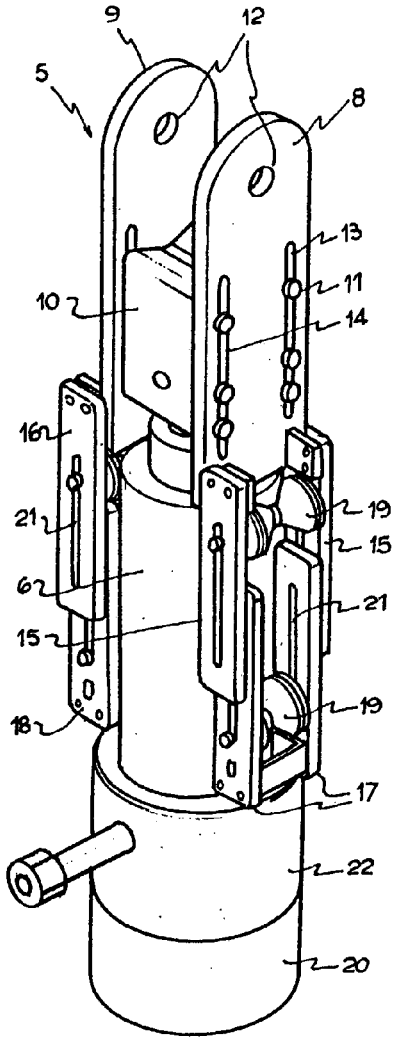
FIG. 2 is a perspective view that shows the body of the tool of this invention in its general external composition, before mounting.
Figure 3:
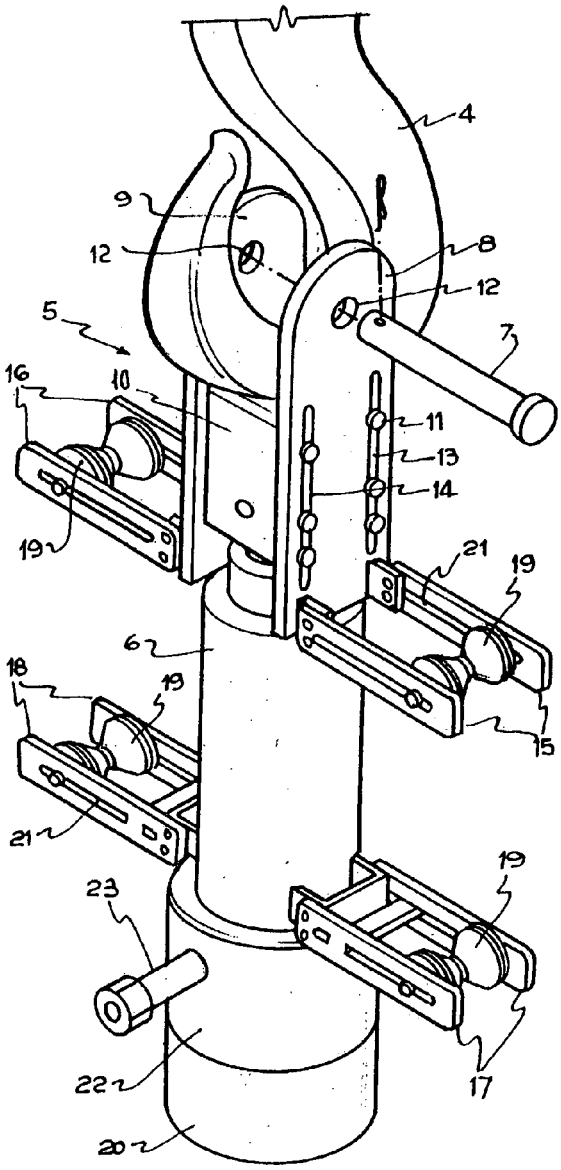
FIG. 3 is a perspective view of the body of the same figure tool from the previous figure, which shows the general configuration adopted when it is disposed for usage.

Considering now FIGS. 2 and 3, it can be understood how the mentioned support array (5) is formed, hanging from hook (4) of block (2) through a transverse member, such as a bushing bolt (7), which goes through the lateral members, or plates, (8) and (9) through its upper holes (12); these plates being associated with the upper, or higher, core (10), which belongs to the body of the tool, through the transversal screws (11). Said higher core (10) has vertical alignment pairs of threaded holes (not shown), defined on its side walls, on which the mentioned plates (8) and (9) are supported, carrying their respective pairs of elongated vertical openings (13) and (14), which face the mentioned threaded hole alignments of the core (10).

Figure 4:
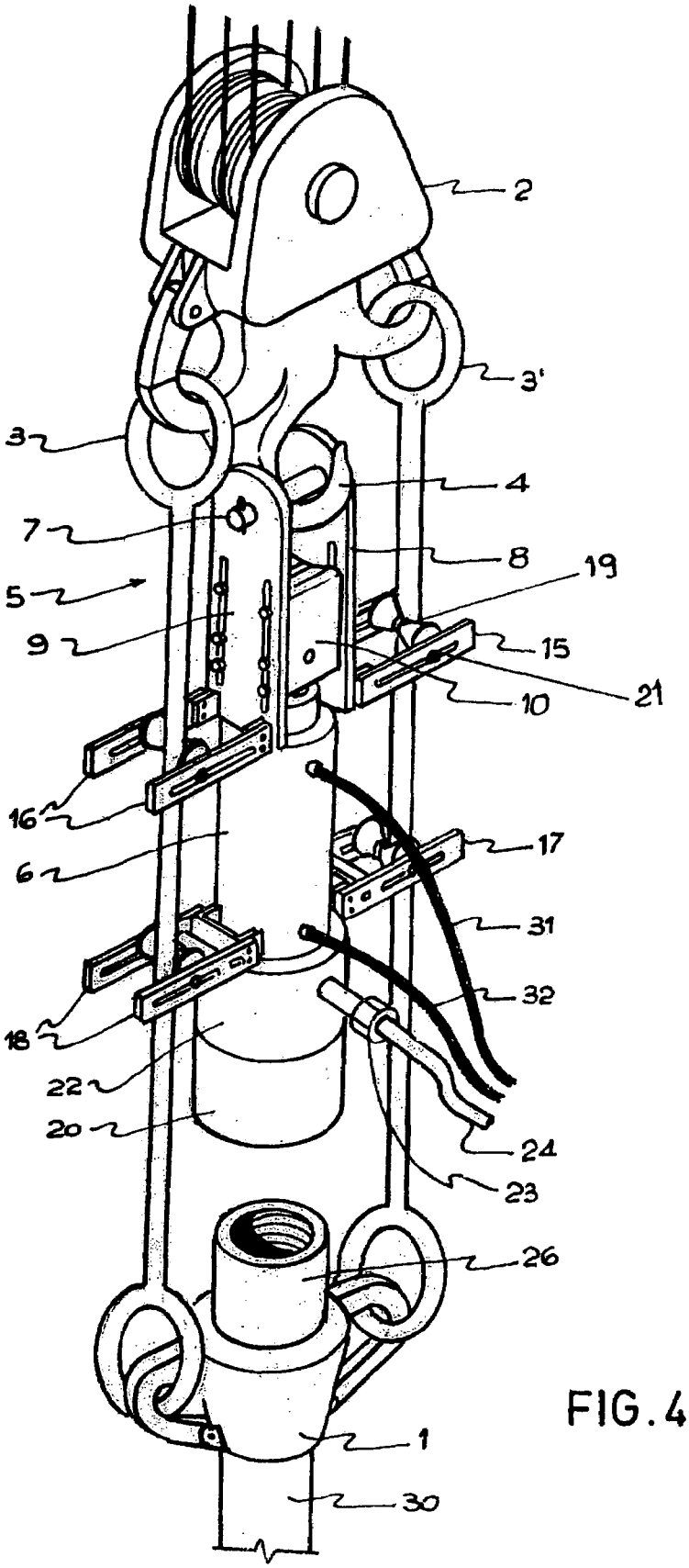
FIG. 4 is a perspective view of which shows the tool of the invention already positioned between the block and the hanging means, facing the joint couple of the last tube of pipe that remains hanging.

This mounting means has been designed to allow the variation of the tool, adapting it to the length of the "amelas" which existed before the drilling equipment. It can be appreciated that, for its mounting, the tool body may be displaced vertically with respect to the mentioned lateral plates (8) and (9), and in that the adequate distance can be determined with respect to tube (30) so that, when it performs its mating and decoupling movements, its packing array or block bushing (20) always encompasses the aforementioned joint couple (26). Once the tool has been positioned, and its length has been determined (operation height), with the mentioned transversal screws (11), the definitive anchorage occurs. It is a special positioning device, defined by the core (10) and the plates (8) and (9), which allow the variation of the tool length in the vertical direction, ensuring that their free lower end, where the block bushing (20) is located, is always at the right distance so that its operational displacements adequately produce the mating and decoupling. FIGS. 2, 3 and 4 are useful for appreciating the mentioned displacements for the mating and decoupling; they are also guided by the amelas (3/3') which exist before the drilling equipment. To that end, the retractile arm pairs (15), (16), (17) and (18) are included, carrying their respective freely rotational centering rolls (19).

Once the tool has been positioned and its length defined, the mentioned arms 15/18) are extended until they are in a horizontal position (FIGS. 3 and 4), so that the throat of each centering rolls rests (in a slipping position) on the "amelas" (3/3') that act as guides preventing the tool from losing vertical alignment during operation, and thus avoiding undesirable transversal movements.

It can also be appreciated that, in order to adapt to the distance separating the amelas, by centralizing the tool with respect to the vertical alignment axis, each roll (19) may be transversally displaced through the respective guide elongated openings (21) of said retractile arms.

Figure 5:
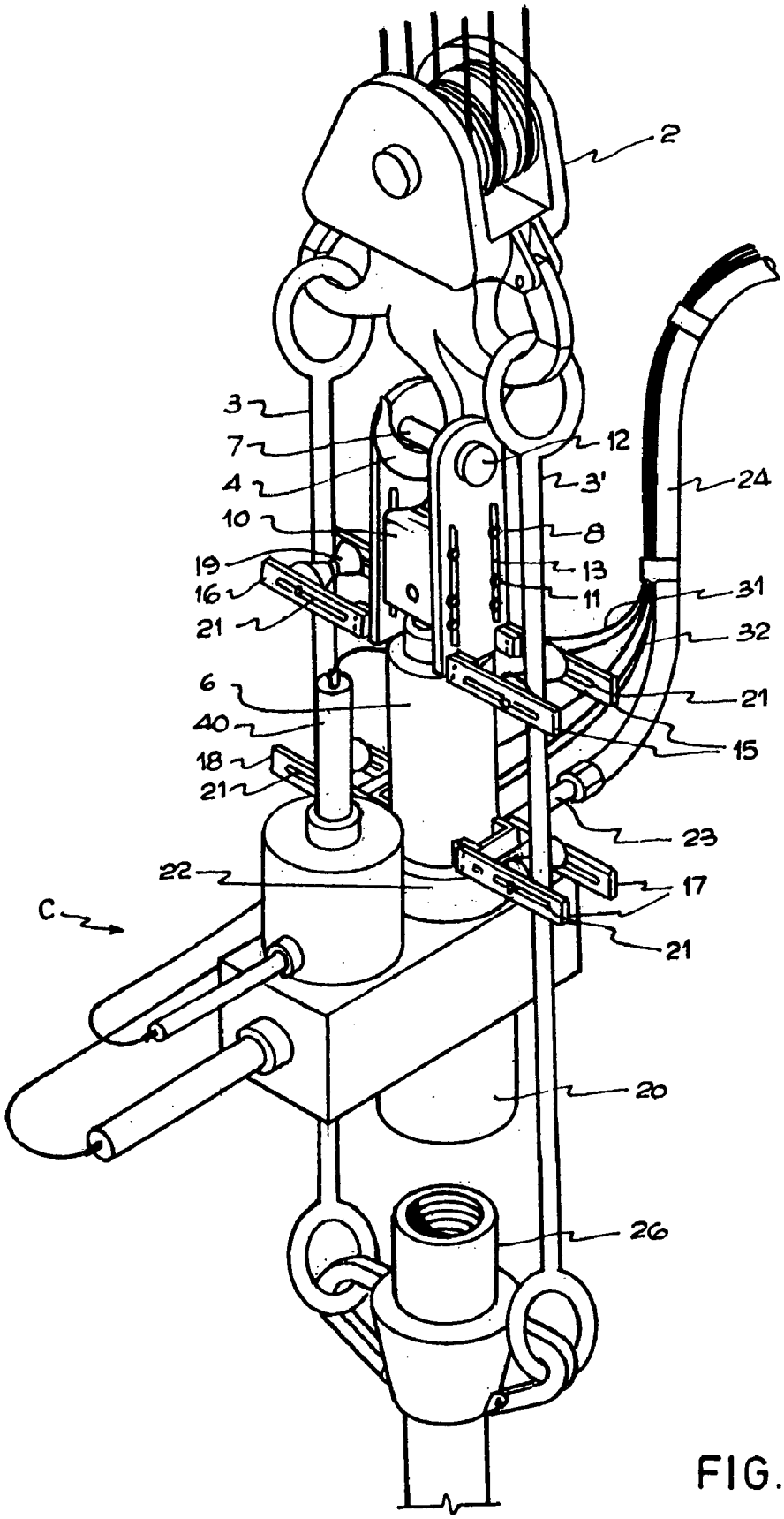
FIG. 5 is a perspective view of the same tool from one of the previous figures, in the version that includes the cement head.

Now looking at FIGS. 4 and 5, it can be appreciated that the tool of the invention includes an injection head (22) that through a connecting beak (23) is attached to a flexible hose (24), of enough strength and length, through which it becomes integrated with the mud injection circuit coming from the drilling fluid storage pools and is driven by a conventional pump (not shown).

Said fluid, after passing through the injection pump, enters the injection head (22), located under the dynamic positioning device (6).

It should be noted that FIG. 5 differs from the previous FIGS. 1A to 4 in that it represents a tool of this invention that has the cement head (C) incorporated.

Figure 6:
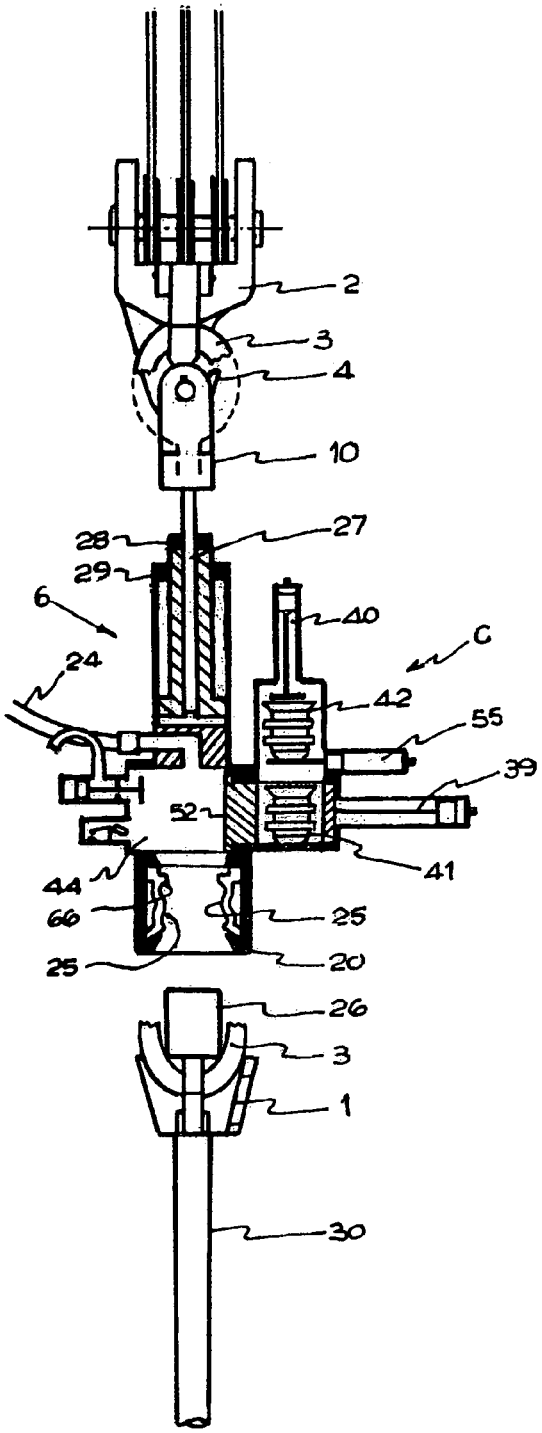
FIG. 6 is a side view, where the tool of the invention is shown in a vertical section, to explain its action as positioning device, when it has the open circuit and the hanging pipe.
Figure 7:
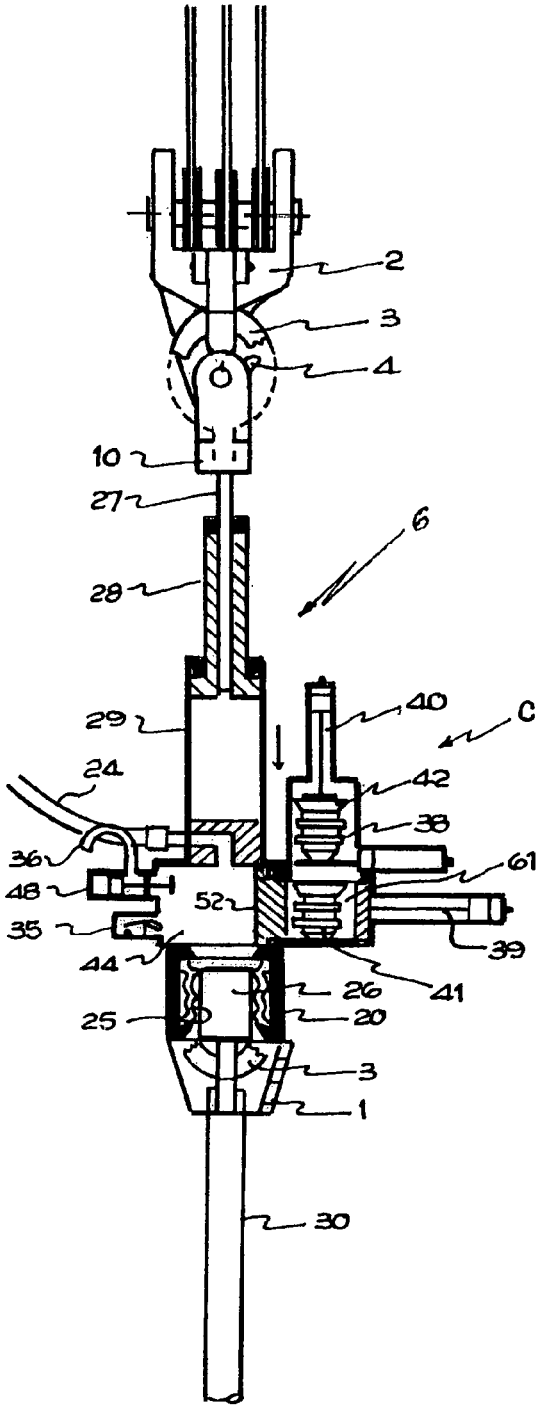
FIG. 7 is a side view, which shows the tool of the invention at a vertical section, to explain its action as a positioning device when the circuit is closed to proceed to fill and/or circulate the well fluid inside the pipe, and through the well-pipe annular space.

Now looking at FIGS. 6 and 7, it is possible to understand the production of the vertical mating and decoupling displacements commanded from the dynamic positioning device (6) of the tool of the invention.

It can be appreciated that from the mentioned higher core (10), the fixed central rod (27) is projected, around which the telescopic hydraulic cylinders (28) and (29) are displaced, linked to a hydraulic pump (not shown) through their respective hydraulic tubes (31) and (32), visible in FIGS. 4 and 5, with the corresponding intercalated operating valves.

In effect, in order to produce the ascending or descending vertical displacements of the sliding and telescopic cylinders (28) and (29), respective hydraulic circuits are established, which are linked to through their flexible tubes (31) and (32) to their respective variable internal volume inner chambers defined by both sliding cylinders, with the mentioned hydraulic operating pump, with intercalated electrovalves for opening and closing the circuits, said valves are commanded from the tool general command, based on pre-established operation programs. This constructive, functional disposition, commanded from the tool general command, produces the aforementioned mating and decoupling movement to ensure that the packing head (20) is positioned embracing the threaded joint couple (26) of tube (30) and thus to create the mud circulation circuit and allow the drilling, circulation and cementation of the well.

In effect, FIGS. 6 and 7 show the tool's sliding capacity before the mating, and after it has been coupled, when drilling fluid is injected with air outlet during tubing, keeping the cement plugs in stand-by position until they need to be used.

FIG. 6 represents the tool in stand-by position; that is, decoupled, with the dynamic positioning array (6) in retracted position, so that the packer or block bushing (20) is far from the tube (30).

FIG. 7 shows the same tool coupled to tube (30). In this case, the same dynamic positioning device (6) is placed in an expanded position, so that the mentioned packer or block bushing (20) is sealing internal communication with tube (30).

Figure 8:
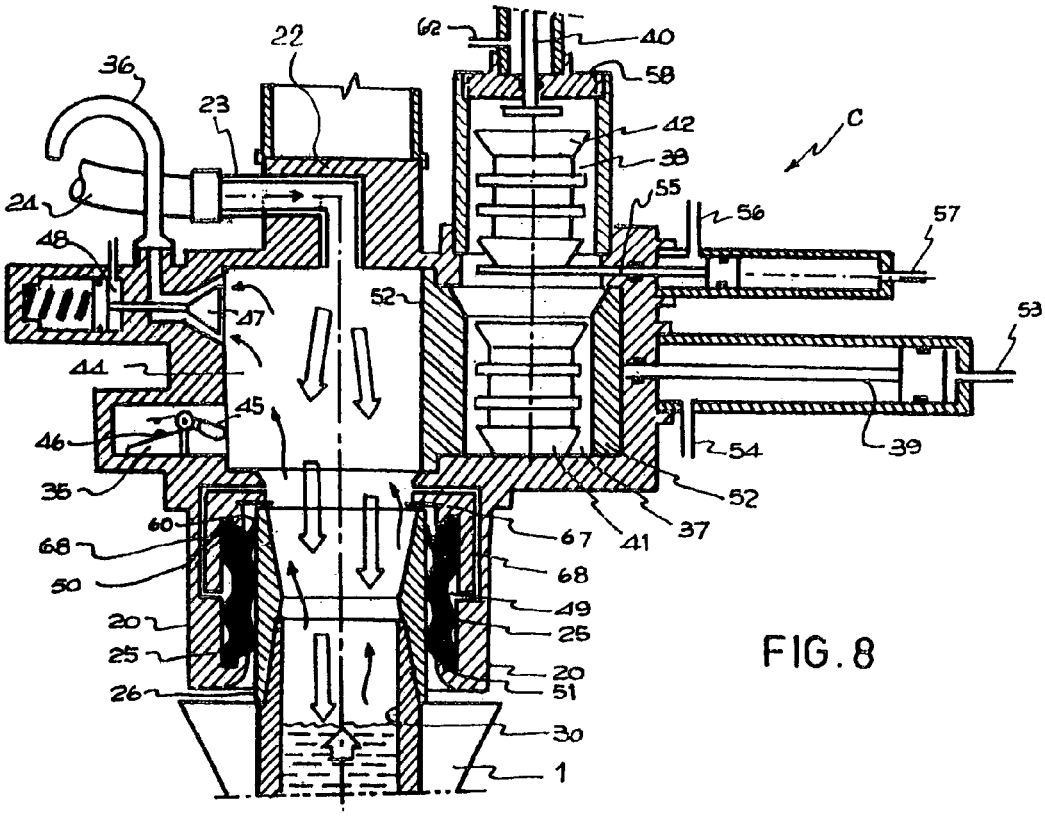
FIG. 8 is a vertical section view that shows in more detail the constitution and disposition of the elastic block means producing the seal during the mating of the tool on the tubing pipe.
Figure 9:
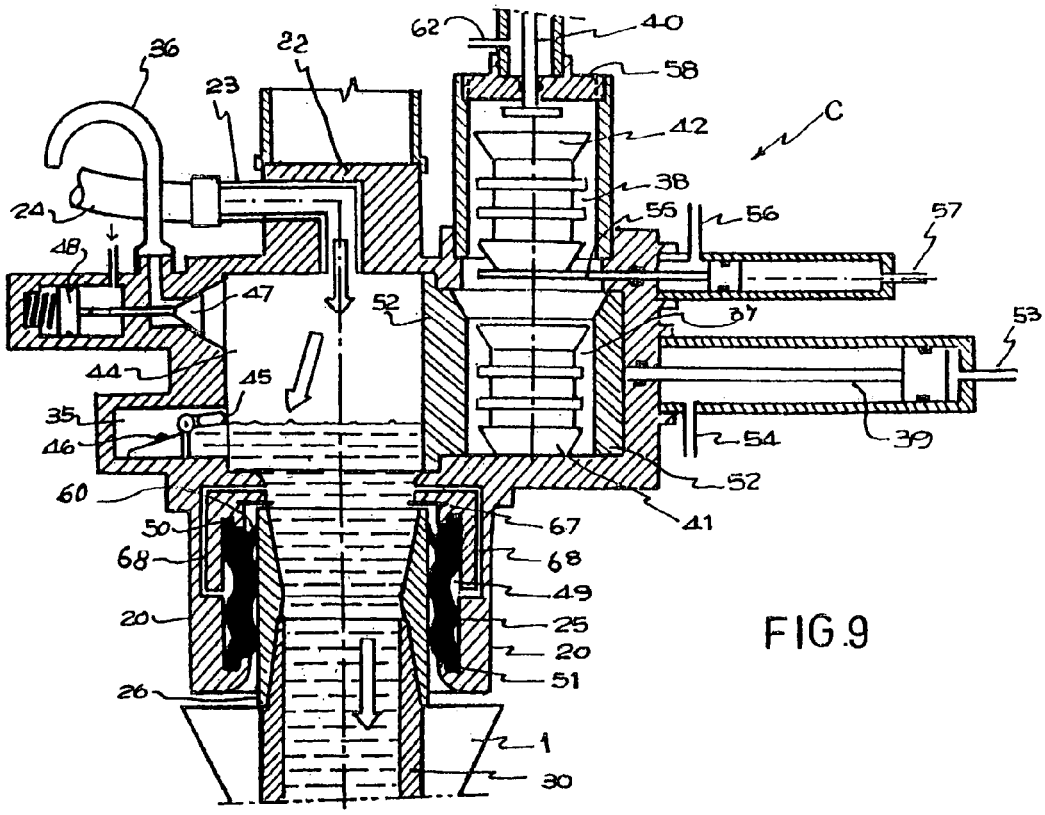
FIG. 9 is a vertical section view, similar to the one of the previous figure, showing in greater detail the behavior of the same elastic block means when they produce the seal during the mating of the tool on the tubing pipe.

Now looking at FIGS. 8 and 9, it can be appreciated that the injection head (22), which provides connection (23) with circulation line (24) to allow the entry of well fluid, is connected internally with a confinement chamber (44), from where the fluid is driven towards the pipe.

As FIGS. 8 and 9 particularly show, the inside of said block bushing (20) is distinguished for including a special self-adjustable annular seal (25) that ensures hermetic blockage when the tool is coupled with the joint (26), which carries tube (30).

In said figures, it can be appreciated that, in correspondence with the confinement chamber (44), a fluid level detector means (35) and an air outlet (36) are included, connected to a valvular means. The lower (37) and upper (38) pockets, linked to launchers (39) and (40) of the respective cement plugs (41) and (42) of the cement head (C) are also shown. FIGS. 8 and 9 also show in greater detail that the fluid level detector (35) comprises a float (45) associated with a contactor (46), from where the valvular means (47/48) is activated, and controls and commands the air outlet (36).

FIG. 8 shows that, when the level of the fluid entering the chamber (44) to connect with the pipe (30) does not reach the level of the mentioned float (45), the valvular means (47/48) is kept open, allowing the air outlet (36). In this preferred embodiment, the mentioned air outlet valvular means comprises a blockage plug (47) which rod is counteracted with an expansion spring that keeps it in a normally open position. When the same valvular means (47/48) is in closed position because the fluid level reaches float (45), the spring action is defeated and the blockage is produced, allowing the drilling fluid to circulate through the inside of the tubular column (30) through the action of the pressure induced by the confinement, and then to move up the tubular well-pipe space.

In effect, the mentioned FIGS. 7 and 9 show that, in order to achieve the mentioned blockage at the end of the column, where the joint couple (26) of the last tube (30) is located, it is necessary for a descending movement of the tool to be produced, towards the pipe, in which case the mentioned dynamic positioning device (6) starts to operate.

In this case, the self-adjustable annular elastic joint (25), mounted on the internal face of the block bushing (20), produces the seal over the couple (26) so that now the mud drive pump can reestablish circulation towards the inside of the pump, in a downward direction, and from the lower end of the same column in an upward direction, circulating from the annular well-pipe space.

It should be highlighted that the produced hydraulic reactions, on the pumping driven fluid mass, are useful in controlling the reactions of the formations crossed, in cleaning and maintaining the continuity of the circuit, situation which allows to determine and control promptly the well's spontaneous reactions.

Looking again at FIGS. 8 and 9, it can also be appreciated how the inside of the mentioned packing array is formed, by a special blockage bushing (20), where the presence of the mentioned self-adjustable annular elastic joint (25) should be noted. In this preferred embodiment, it is mounted on the body of bushing (20) and supported in the external cylindrical surface of the joint couple (26), creating the seal. This coupling is completed with the presence of buffer ring (67), which function is to buffer the impact effect produce when the tool mates and positions itself to produce the entry of circulation fluid.

In said FIGS. 8 and 9, it can be readily appreciated how the annular seal is adjusted based on the pressure of the same circulation fluid.

In effect, it can be appreciated that the body of block bushing (20) defines the connection channel (68), which produces a hydraulic pressure on the mentioned annular seal (25) affixed to it.

Indeed, the annular blockage function implemented by said self-adjustable band (25) is of paramount importance since, for that tubing task, it is convenient for the tubular column to be kept filled with fluid at a certain pressure, which is useful for facilitating this sealing action. FIG. 9 precisely shows the array exerting said sealing action on the mentioned joint couple (26) so that the pressure fluid conducted through the inside of tube (30) can also be used to increase the established blockage pressure.

To that end, the internal face of the body of said block bushing (20) also defines a mounting annular channeling (49) that defines both lower and upper annular flanges, or throats, on its ends, to provide natural anchorage for the end annular tabs (50) and (51) of said annular blockage self-adjustable band (25).

This figure also shows that the same annular band (25) presents in turn respective internal cavities that face the channeling (49) which, in this way serves as an expansion chamber that exerts pressure and in so doing increases the sealing action. The separation of the couple (26), enclosed by the block bushing (20), determines the annular space to be sealed. In addition, the mentioned mounting channeling (49) limited by the mentioned upper and lower throats, is where the inlet for the hydraulic connection tube (48) that comes from the high pressure zone is defined.

The elastic band that integrates the invented seal is also characterized by including a higher annular wing (60) that extends obliquely until it is supported on the body of the couple (26), defining an upper blockage lip which is also self-adjustable according to the hydraulic pressure.

The special conformation and orientation of said annular wing (60) is determined to facilitate the seal, since it presents the first high pressure barrier that tends to deform it towards the wall of the couple (26).

In these same FIGS. 5, 8 and 9, it can also be appreciated that the tool of the invention incorporates the mentioned cement head (C) disposed in supplementary position with respect to positioning device (6).

In this preferred example, the cement head is positioned laterally with respect to the injection circuit, but it is understood that it can be placed above it or in any other position that facilitates its assembly and operation.

It is also appreciated that said confinement chamber (44) is completed with the front wall of the carrying sliding box (52) that closes hermetically, keeping the isolation of the inside of the pocket (37).

The presence of the lower or fuse displacement plug (41) and of the higher or blockage plug (42) can also be observed, which are used to circulate the fluids to be injected during cementation.

In order to launch these plugs, the hydraulic operation side launcher (39) is used, which defines the corresponding fluid inlet and outlet (53/54); the corresponding hydraulic operation lock actuator (55); for which it defines its respective fluid inlet and outlet (56/57); the upper pocket (38) which cover (58) supports hydraulic operation vertical launcher (40), for which it defines its respective fluid inlet and outlet (62) and (64), ((62) is shown).

FIGS. 10, 11, 12 and 13 are graphic descriptions of the practice of the cementation process, introducing plugs (41) and (42) sequentially in the fluid flow entering the pipe.

This general configuration shows that the tool of the invention is distinguished from currently known tools and methodologies in that it ensures that the complete tubing process is performed by injecting the fluid without the presence of air, at any time during tubing, in all the inter-threaded tubes that make up the column, or as determined by its sequential programs, so that once the tubing has been completed, the cementation stage can follow, without interrupting or discontinuing the circuit, and without the presence of wellhead personnel, saving time and enhancing safety.

Figure 10:
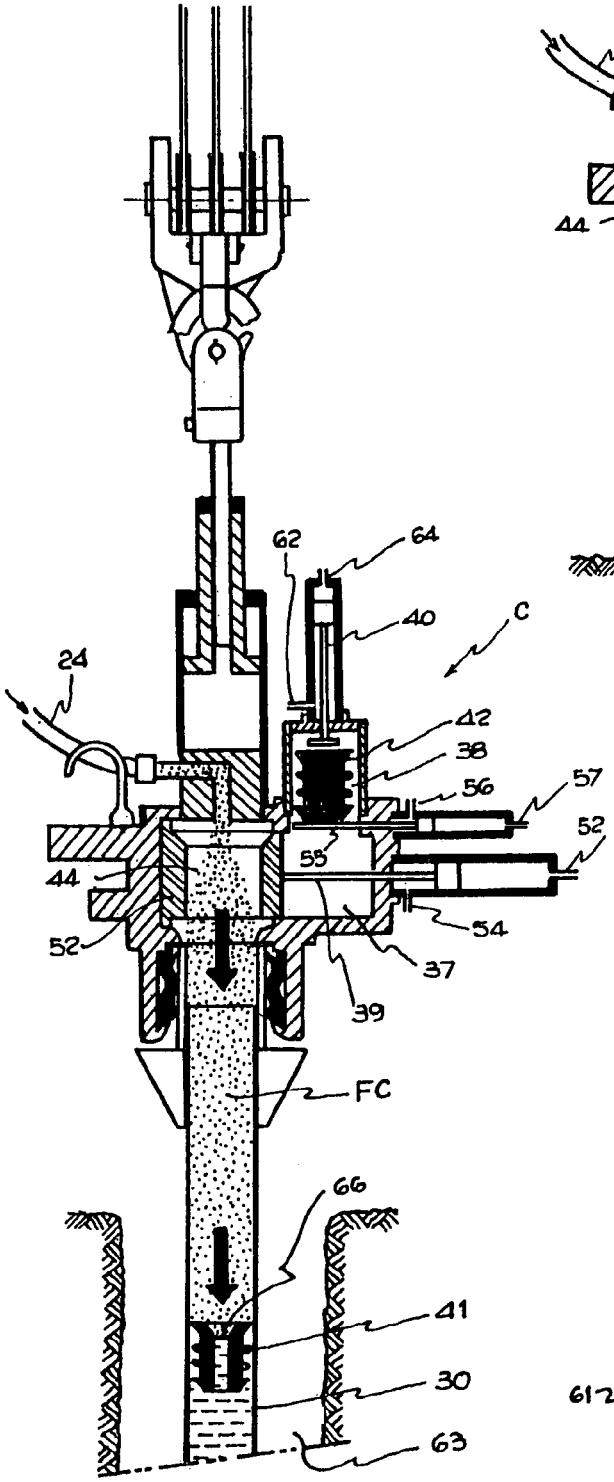
FIG. 10 is a longitudinal section view which represents schematically the behavior of the tool as a cement head, with a hydraulic plug launcher, in this case launching the lower cement plug.

The schematic section of FIG. 10 shows the beginning of the cementation operation. The hydraulic operated launch (39) displaced the box (52) towards the confinement chamber (44), positioning the lower plug (41), which enters the downward fluid flow circulating inside the pipe.

This lower plug is displaced by cement fluids (FC), while the fluid that is being circulated through said lower plug arrives at the lower end of the pipe and climbs through the annular well-pipe space (63).

Figure 11:
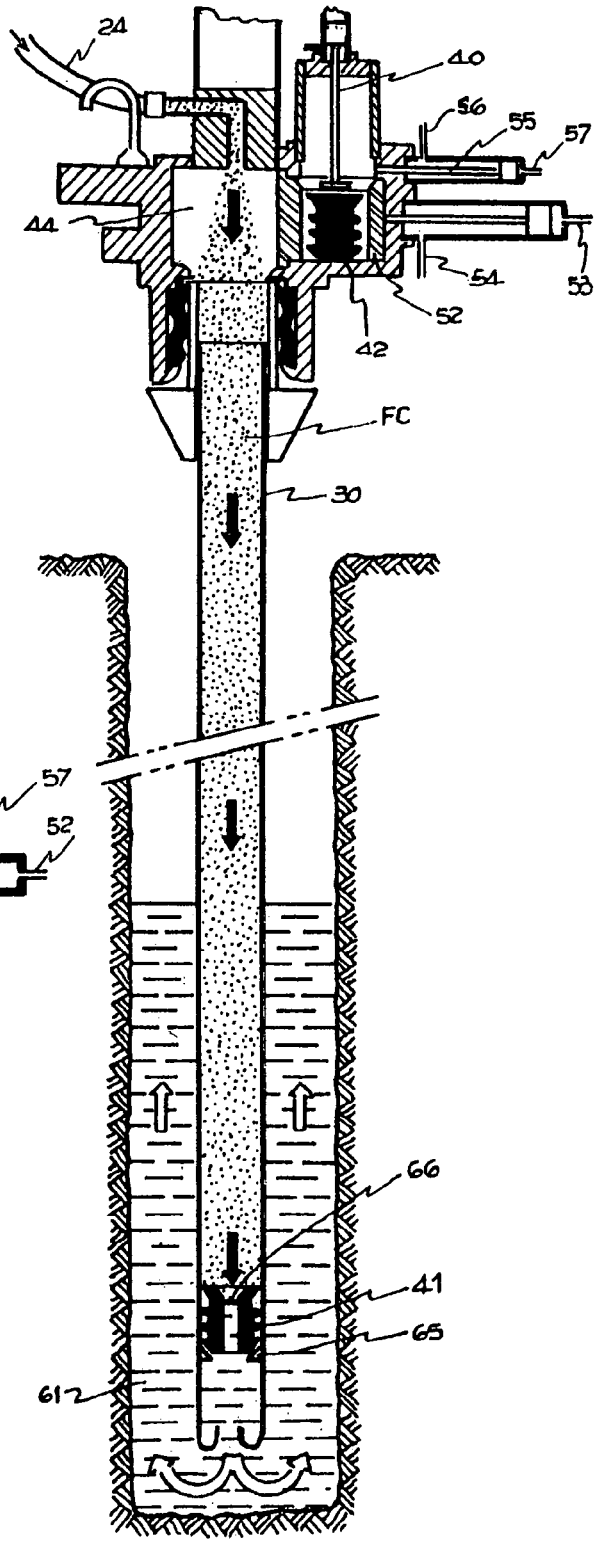
FIG. 11 is a longitudinal section view which represents schematically the behavior of the tool as a cement head, with a hydraulic plug launcher, in this case at a stage during the cementation operation.

FIG. 11 shows that, while the mentioned lower plug travels to the bottom of the tube pipe (30), driven by the injected cement fluid (FC), the carrying box (52) was retracted to the side pocket (37) commanded by the hydraulic operator of the same hydraulic launcher (39).

At the same time, the lock actuator (55) opening is displaced, allowing the mentioned upper plug (42) to be displaced by its respective launcher (40), and is housed in the mentioned carrying box (52).

Figure 12:
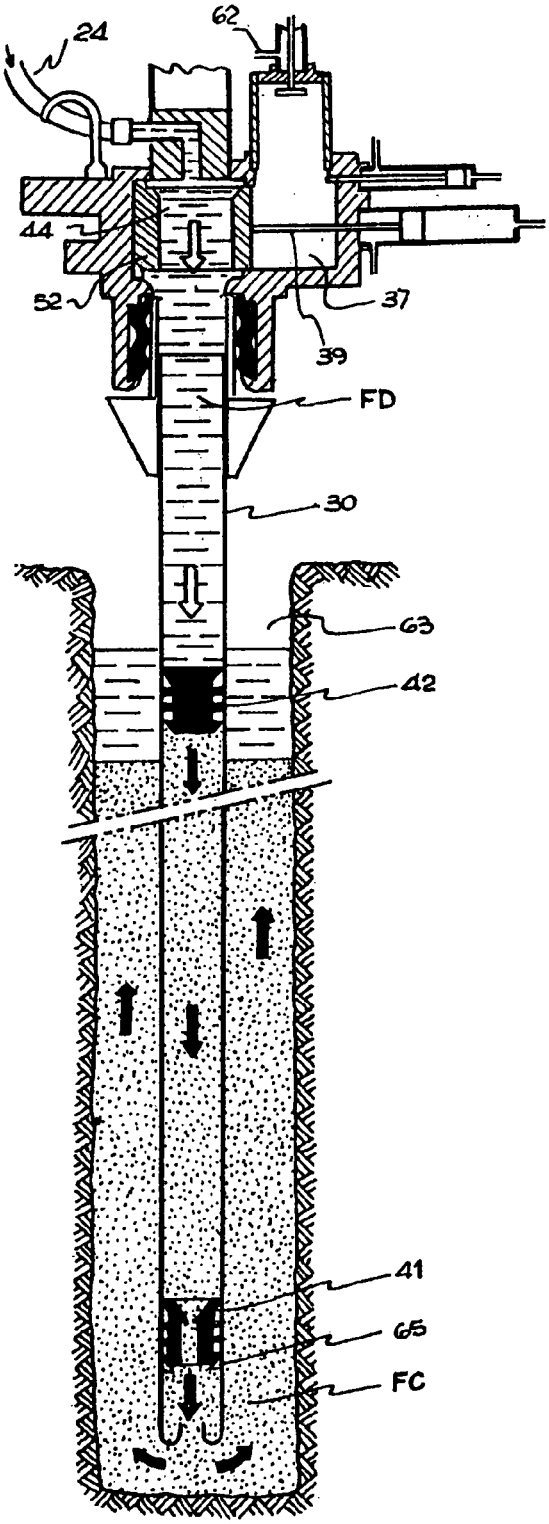
FIG. 12 is a longitudinal section view schematically representing the behavior of the tool as a cement head, with a hydraulic plug launcher, in this case at another stage during the cementation operation.

FIG. 12 shows that the mentioned lower plug (41) stops on the baffle (65) and, by the action of the cement fluid pressure, breaks its membrane (66) (visible in FIGS. 10 and 11). In this way, the cement fluids (FC) are taken to the well-pipe annular space (63).

In this same FIG. 12, it can be seen that the mentioned carrying box (52) was displaced, by the action of the side launcher (39), positioning the upper plug (42) in the fluid circulation circuit so that it acts as a block plug in the lower end of the tube pipe (30).

Said block plug (42) is driven by the displacement fluid (generally water) (DF), so that the cement fluid (FC) can go through the lower plug (41) (open) to head towards the well-pipe annular space (63).

Figure 13:
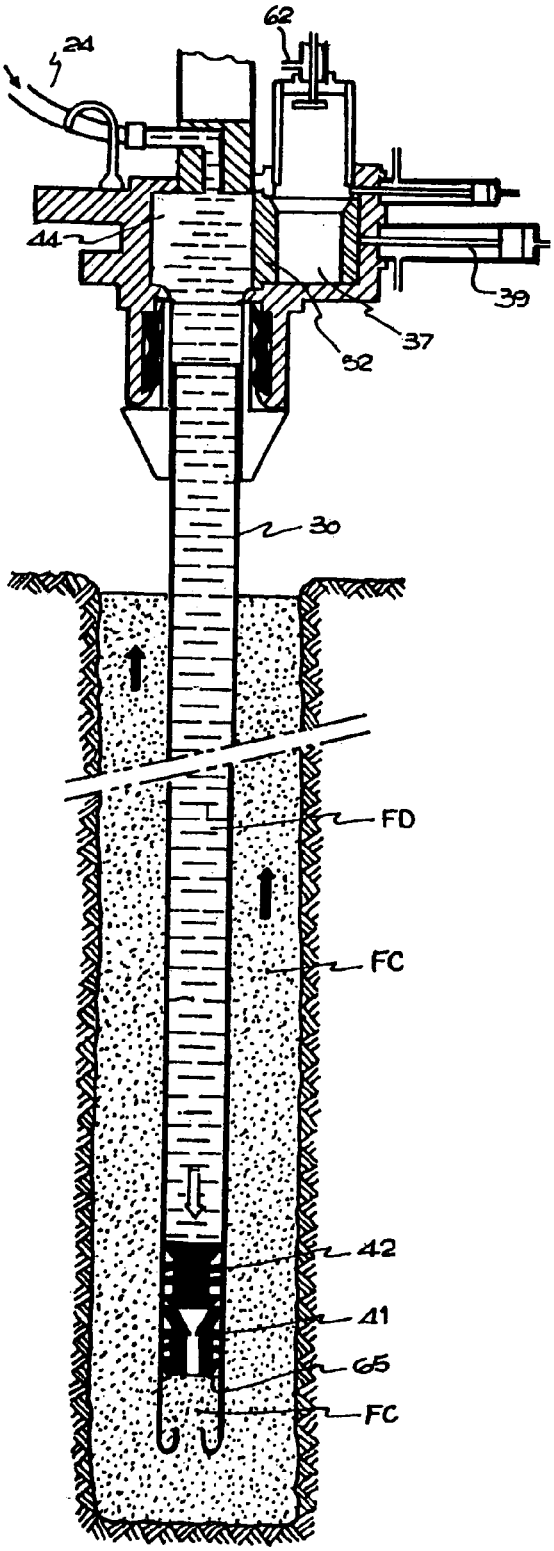
FIG. 13 is a longitudinal section view schematically representing the behavior of the tool as a cement head, with a hydraulic plug launcher, in this case when completing the cementation operation.

FIG. 13 shows the completed cementation operation. The block plug (42) reached the lower end of the tubing pipe and was positioned on the lower plug (41). The volume of cement fluid redirected towards the well-pipe space (63) is the necessary one to encompass it completely. The carrying box (52) is again positioned in a retracted mode, and the displacement fluid (DF) is confined in the inside of the tubing pipe.

It should be highlighted that the general command of this tool us located far from the tool, at the most convenient location, integrating the general installation command in such a way that the hydraulic fluid conducting hoses that operate the dynamic positioning device (6), and the corresponding hoses that operate the launchers of the cement head (C) may be housed in a single multiple conductor of great length, such as the one shown in FIG. 5, which could be referred to as an umbilical cord.

The invention claimed is:

1. A tool for fluid filling and circulation during oilfield well tubing, the tool capable of being positioned in drilling equipment having a block (2), a hook (4) supported by the block, tube elevating means (1), and connectors (3,3') spaced from one another and connecting the block to the tube elevating means, comprising:

an upper core (10) adapted to oscillate on the hook;

two opposed side members (8) and (9) attached to the upper core;

a transverse member (7) adapted to hang on the hook, the transverse member extending from one of the side members to the other of the side members;

a telescopic dynamic hydraulic positioning device (6) connected to the upper core (10), wherein the tool has a length, the positioning device operable to increase and decrease the length of the tool to produce mating and decoupling displacements of the tool, and the positioning device includes a first hydraulic cylinder (28) and a second hydraulic cylinder (29) of greater diameter than the first hydraulic cylinder, the first hydraulic cylinder being coaxially positioned in the second hydraulic cylinder;

an injection head (22) mounted on the positioning device and defining a confinement chamber (44) adapted to be connected to a source of drilling mud; and a bushing (20) mounted on the injection head, the bushing having an internal annular seal (25) adapted to form a hermetic seal with a tube of the oilfield well tubing by encompassing the tube.

2. The tool of claim 1, wherein fluid under pressure flows through the bushing, and the internal annular seal (25) comprises means for forming a hermetic seal having a strength proportional to the pressure of the fluid flowing through the bushing.

3. The tool of claim 1, wherein the side members (8) and (9) have elongated openings (13) and (14) extending in the length direction of the tool, and transverse screws (11) are received in the elongated openings and in the upper core to fix the core at a selected height relative to the side members and thereby enable the length of the tool to be adjustable so that the positioning device is operable to produce mating and decoupling displacements of the tool for drilling equipment of various lengths.

4. The tool of claim 1, further comprising retractile arm pairs (15,18) each carrying a freely rotational centering roll (19) adapted to rest on one of the connectors of the drilling equipment to prevent the tool from losing longitudinal alignment during displacements.

5. The tool of claim 1, wherein the positioning device (6) includes a fixed central rod (27) around which the hydraulic cylinders (28) and (29) are displaced, the hydraulic cylinders increasing and decreasing the length of the tool.

6. The tool of claim 1, wherein the internal annular seal (25) is adapted to be positioned in an annular space between an inner surface of the bushing (20) and a threaded joint couple (26) of a tube, whereby couplings in the tubing are hermetically sealed.

7. The tool of claim 6, wherein the bushing (20) includes an inwardly extending buffer ring (67) adapted to project over a threaded joint couple (26) of a tube to buffer the impact produced when the tool mates and positions itself to produce entry of a circulation fluid.

8. The tool of claim 6, wherein the internal annular seal (25) comprises an annular elastic self adjustable band mounted in an annular channel in the bushing (20), the band projecting from the annular channel such that the band is adapted to seal with the threaded joint couple (26).

9. The tool of claim 8, wherein the band and the annular channel define an internal expansion chamber communicating through at least one passage (68) in the bushing (20) with pressure fluid in the bushing to produce transverse fluid pressure on the band.

10. The tool of claim 9, where the internal expansion chamber increases in volume according to an increase of the pressure fluid introduced in the chamber.

11. The tool of claim 8, wherein the band has superior (50) and inferior (51) annular tabs, and the annular channel has upper and lower annular flanges engaging the annular tabs and thereby retaining the band.

12. The tool of claim 8, wherein the band includes an annular wing (60) extending obliquely inward and upward for engagement with the threaded joint couple, thereby defining an upper blockage lip and an annular valley that regulates the degree of sealing pressure of the band according to the pressure of the fluid in the bushing (20).

13. The tool of claim 8, wherein the external face of the elastic self adjustable band (25) has cavities allowing the presence of support lips over the external face of couple (26) which produce the sealing.

14. A tool for fluid filling and circulation during oilfield well tubing, the tool capable of being positioned in drilling equipment having a block (2), a hook (4) supported by the block, tube elevating means (1), and connectors (3,3') spaced from one another and connecting the block to the tube elevating means, comprising:

an upper core (10) adapted to oscillate on the hook;

two opposed side members (8) and (9) attached to the upper core;

a transverse member (7) adapted to hang on the hook, the transverse member extending from one of the side members to the other of the side members;

a telescopic dynamic hydraulic positioning device (6) connected to the upper core (10), wherein the tool has a length, the positioning device operable to increase and decrease the length of the tool to produce mating and decoupling displacements of the tool, and the positioning device includes a first hydraulic cylinder (28) and a second hydraulic cylinder (29) of greater diameter than the first hydraulic cylinder, the first hydraulic cylinder being coaxially positioned in the second hydraulic cylinder;

a cement head (C) defining a pushing and confinement chamber (44) adapted to be connected to a source of drilling mud, the cement head defining pockets (37,38) containing cement plugs (41,42), the chamber being in communication with the pockets, and the cement head having launches (39,49) capable of moving the cement plugs into the pushing and confinement chamber (44); and a bushing (20) mounted on the cement head, the bushing defining an interior in communication with the pushing and confinement chamber and having an internal annular seal (25) adapted to form a hermetic seal with a tube of the oilfield well tubing by encompassing the tube.

15. The tool of claim 14, wherein the pushing and confinement chamber (44) is coaxial with the bushing, the bushing being adapted to receive the tube coaxially.

16. The tool of claim 14, wherein the pushing and confinement chamber (44) includes an air outlet (36) having air outlet valve means (47/48) to control air outlet during the tubing and a fluid level detector (35) to close the air outlet valve means in response to an adequate level of fluid in the chamber.

* * * * *